US006421868B1

(12) United States Patent
Tran

(10) Patent No.: US 6,421,868 B1
(45) Date of Patent: Jul. 23, 2002

(54) ADJUSTABLE HANDLE ASSEMBLY FOR FLOOR CARE MACHINES

(75) Inventor: Loi Xuong Tran, Conifer, CO (US)

(73) Assignee: Windsor Industries, Inc., Englewood, CO (US)

( * ) Notice: Subject to any disclaimer, the term of this patent is extended or adjusted under 35 U.S.C. 154(b) by 1 day.

(21) Appl. No.: 09/675,551

(22) Filed: Sep. 27, 2000

(51) Int. Cl.[7] ..... A47L 11/00
(52) U.S. Cl. ..... 15/49.1; 15/98
(58) Field of Search ..... 15/49.1, 98, 144.4

(56) References Cited

U.S. PATENT DOCUMENTS

| | | | |
|---|---|---|---|
| 889,088 A | | 5/1908 | Baillargeon |
| 1,918,519 A | | 7/1933 | Clements |
| 2,536,607 A | | 1/1951 | Jenkins |
| 2,702,395 A | | 2/1955 | Zaiger |
| 3,204,272 A | * | 9/1965 | Greene |
| 4,204,292 A | | 5/1980 | Lester et al. |
| 4,662,026 A | | 5/1987 | Sumerau et al. |
| 5,088,147 A | | 2/1992 | MacMillan |
| 5,220,707 A | | 6/1993 | Newman, Sr. et al. |
| 5,322,334 A | | 6/1994 | Hammer |
| 5,327,610 A | | 7/1994 | Smith |

OTHER PUBLICATIONS

Windsor "Clean Smart" Brochure, 1997.
Windsor "Merit Deluxe" Brochure 1995.

* cited by examiner

*Primary Examiner*—Randall E. Chin
(74) *Attorney, Agent, or Firm*—Sheridan Ross P.C.

(57) ABSTRACT

A floor care machine with an adjustable handle assembly that allows an operator to quickly and conveniently adjust the angular position of the handle relative to the floor working unit is provided. The handle adjustment assembly allows the operator to select the handle position by hand without bending or otherwise placing the operator in a non-preferred ergonomic position. The handle adjustment assembly features a clamping mechanism with an adjustment lever for securement and release of a frictional grip of the main handle member to maintain the position of the handle relative to the floor working unit.

14 Claims, 4 Drawing Sheets

ADJUSTABLE HANDLE ASSEMBLY FOR FLOOR CARE MACHINES

FIELD OF THE INVENTION

The present invention relates to floor care machinery and more particularly to an infinitely adjustable handle with a releasable clamp for floor care machines such that the operator may position the handle so as to optimize the operator's control of the machine and ergonomic correctness.

BACKGROUND OF THE INVENTION

Various types of floor care machines are currently available in the marketplace including machines that scrub, sweep, polish and/or burnish the floor surface. Such floor care machines typically include a base, an electric motor coupled to the base and a handle attached to the base for guiding and operating the floor care machine. Presently available floor care machines can provide for adjustment of the handle relative to the base. Many floor care machines are electrically powered, often requiring power cords. The handle designs of many of the floor care machines with associated electrical cords incorporate hooks for coiling the cord during periods of non-use.

One known handle adjustment mechanism provides a low-mounted cam-action lever, mounted directly to the base, which tightens a clamp that is otherwise free to slide on the handle. This mechanism allows for continuous adjustment of the handle relative to the base, but has a major disadvantage. The operator must either use a foot to actuate the clamp lever or bend over to reach the low-mounted lever by hand. Operating the lever by foot is acceptable when shifting the lever downward, but is ergonomically poor and difficult when shifting the actuator upward. The operation of the low-mounted lever by hand is ergonomically improper because the operator must exert force while bending or kneeling.

Another known handle adjustment mechanism provides a high-mounted handle release for a pawl and gear, or a pawl and notched plate. With this mechanism, the operator can select from a "storage" position (typically vertical) and several "working" positions. The operator actuates a release lever to disengage the pawl from the gear or notched plate. Once the handle is positioned as desired, the operator releases the lever such that the handle settles into the nearest gear or notch. This adjustment mechanism can suffer from certain drawbacks. First, it is relatively expensive and complex to manufacture, thus generally relegated to expensive, feature-rich machines. Second, this mechanism limits the operator to a few specific handle positions. Unless the handle coincidentally falls into an ideal position, the operator is forced to work in an incorrect position. Third, this mechanism typically is subject to manufacturing tolerances and, hence, the handle position will have some "play" or "slop." This noticeable looseness in the handle position reduces the operator's necessary precision in controlling the floor care machine, especially in low speed polishers where precise control can be crucial.

Yet another known handle adjustment design employs an expandable split ring mechanism on the interior tube of concentric, telescoping tubes to provide a releaseable friction clamp. While this design provides a high-mount handle and continuous adjustment, this split ring configuration appears to increase the cost of machine manufacture and assembly thereof. Moreover, the interior location of the clamping mechanism may make repair and maintenance challenging and time consuming.

In view of these perceived deficiencies in known floor care machines, it would be beneficial to provide an adjustable handle for a floor care machine in which the operator may conveniently and quickly adjust the handle to the desired location. It would also be advantageous to provide the operator of a floor care machine with a high-mounted lever to adjust the handle without placing himself or herself in an ergonomically undesirable position.

SUMMARY OF THE INVENTION

In accordance with the present invention, an adjustable handle assembly for floor care machines is disclosed. The adjustable handle assembly allows the operator of a floor care machine to conveniently adjust the handle unit of the machine relative to the floor working unit of the machine. Proper adjustment gives the operator optimal control over the floor working unit while working in a proper ergonomic position.

The floor machine of the present invention includes a floor working unit, a main handle assembly, and a handle adjustment assembly. The floor working unit performs the desired surface treatment, hence may include a scrubber pad or a burnishing disc. The main handle assembly is connected to the floor working unit and includes a gripping handle. The gripping handle is the means by which the operator grasps and controls the floor machine. The handle adjustment assembly includes an adjustment member and a locking assembly with an adjustment lever and a clamping mechanism. The operator of the floor machine may adjust the position of the main handle assembly by releasing the locking assembly, positioning the main handle assembly as desired, and securing the locking assembly. The release and securement of the locking assembly can be performed by moving the adjustment lever which actuates the clamping mechanism.

In another embodiment, the main handle assembly may include a main handle member. The main handle member may be a tube or a solid shaft. The adjustment member of the handle adjustment assembly is moveable relative to the main handle member. The handle adjustment assembly and the main handle member can be concentric tubes with the main handle member interior to the handle adjustment assembly.

The clamping mechanism of the handle adjustment assembly may include a first clamp block and a second clamp block, although a single, split block could be used. In the embodiment having two blocks, the clamp blocks are interconnected and attached to the handle adjustment assembly and are located exteriorly to the main handle member. The first clamp block may be moved toward or away from the second clamp block by moving the adjustment lever. The clamping mechanism may also contain an adjustment rod connected to the adjustment lever and the first and second clamp blocks. The adjustment rod can be pivotally connected to the adjustment lever and moveably connected to both the first clamp block and the second clamp block. The adjustment lever may incorporate a cam-type design on its contact surface with the first clamp block. The cam-type interface provides for the tensioning and release of the adjustment rod by positioning the adjustment lever along the cam surface.

The relative position of the main handle member to the handle adjustment assembly may be secured by pivoting the adjustment lever such that the first and second clamp blocks moved towards each other. The first and second clamp blocks frictionally grip the main handle member.

The handle adjustment assembly may also incorporate a lower block on the opposite end of the handle adjustment assembly from the first and second clamp blocks. The lower block may provide a mounting surface for two link arms. The link arms are attached to the lower block and may be pivotally connected to the main handle assembly or the floor working unit. Thus, the link arms maintain a spatial relationship between the lower block and either the main handle assembly or the floor working unit. The lower block may also incorporate a lower power cord wrapping member for storage of a power cord during periods of non-use. The power cord may be wrapped around the lower power cord wrapping member and the gripping handle. The main handle assembly may incorporate an upper power cord wrapping member. In this embodiment, the power cord is wrapped around the lower and upper power cord wrapping members, leaving the gripping handle unencumbered by the cord.

Based on the foregoing summary, a number of worthwhile aspects of the present invention can be readily identified. A floor machine is provided with a simple and convenient way of adjusting the handle of a floor machine relative to the base unit. The operator of the floor care machine may grasp and actuate the adjustable lever while holding the gripping handle. Since the adjustable lever is near the gripping handle, the operator need not place himself or herself in a physically compromising position to adjust the handle. The selection of an operating position is equally simple, since the operator need only to pivot the adjustment handle to secure the handle position. The simplicity of the design may reduce manufacturing costs such that the adjustable handle design of the present invention is available even on the less expensive models of floor care machines. Finally, the inherent design of the handle adjustment assembly is such that distance from the lower power cord wrapping member and the gripping handle, or the upper power cord wrapping member if so equipped, is greatest in the stored position. This allows the operator to quickly and easily remove the cord, without unwinding it, by simply lowering the handle from the storage position and placing the cord aside.

Additional advantages of the present invention will become readily apparent from the following discussion, particularly when taken together with the accompanying drawings.

DETAILED DESCRIPTION OF THE PREFERRED EMBODIMENT

Figure 1:
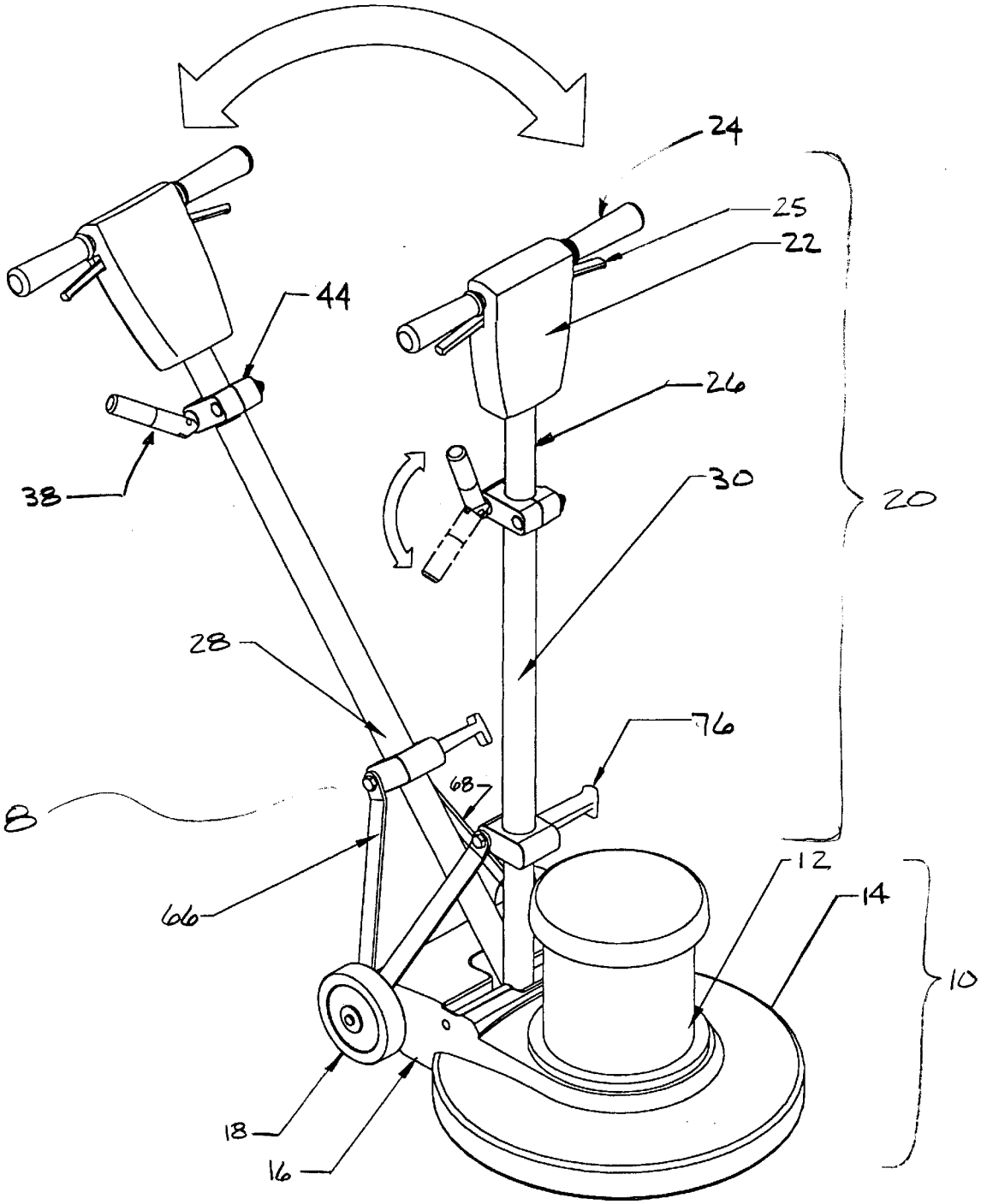
FIG. 1 is a perspective view of the floor care machine of the present invention with the adjustable handle shown in the stored position and in an operating position.

With reference to FIG. 1, a floor machine 8 with a floor working unit 10 and an adjustable handle unit 20 is illustrated. The floor working unit 10 typically comprises a motor 12 mounted on a disc housing 14. The motor 12 drives a floor working pad (not shown) selectively chosen to accomplish the desired floor work, i.e., polishing or burnishing. The motor 12 drive shaft extends through the disc housing 14 and attaches to the floor working pad. The floor working unit 10, as shown, includes a frame 16 for connecting the handle unit 20 with the floor working unit 10. Two wheels 18 are connected to the frame 16 to facilitate transportation of the floor machine 8. Other embodiments of the floor working unit 10 may be employed. For example, the disc housing 14 may be a solid casting with built-in connection brackets for the handle unit 20 and wheels 18.

The handle unit 20 of the present invention includes a main handle member 26 and a main handle assembly 22, including a gripping handle 24 and a floor working unit engagement lever 25. The main handle member 26 is pivotally connected to the floor working unit 10 at one end. The main handle assembly 22 is attached to the main handle member 26 at the opposite end from the floor working unit 10.

Figure 2:
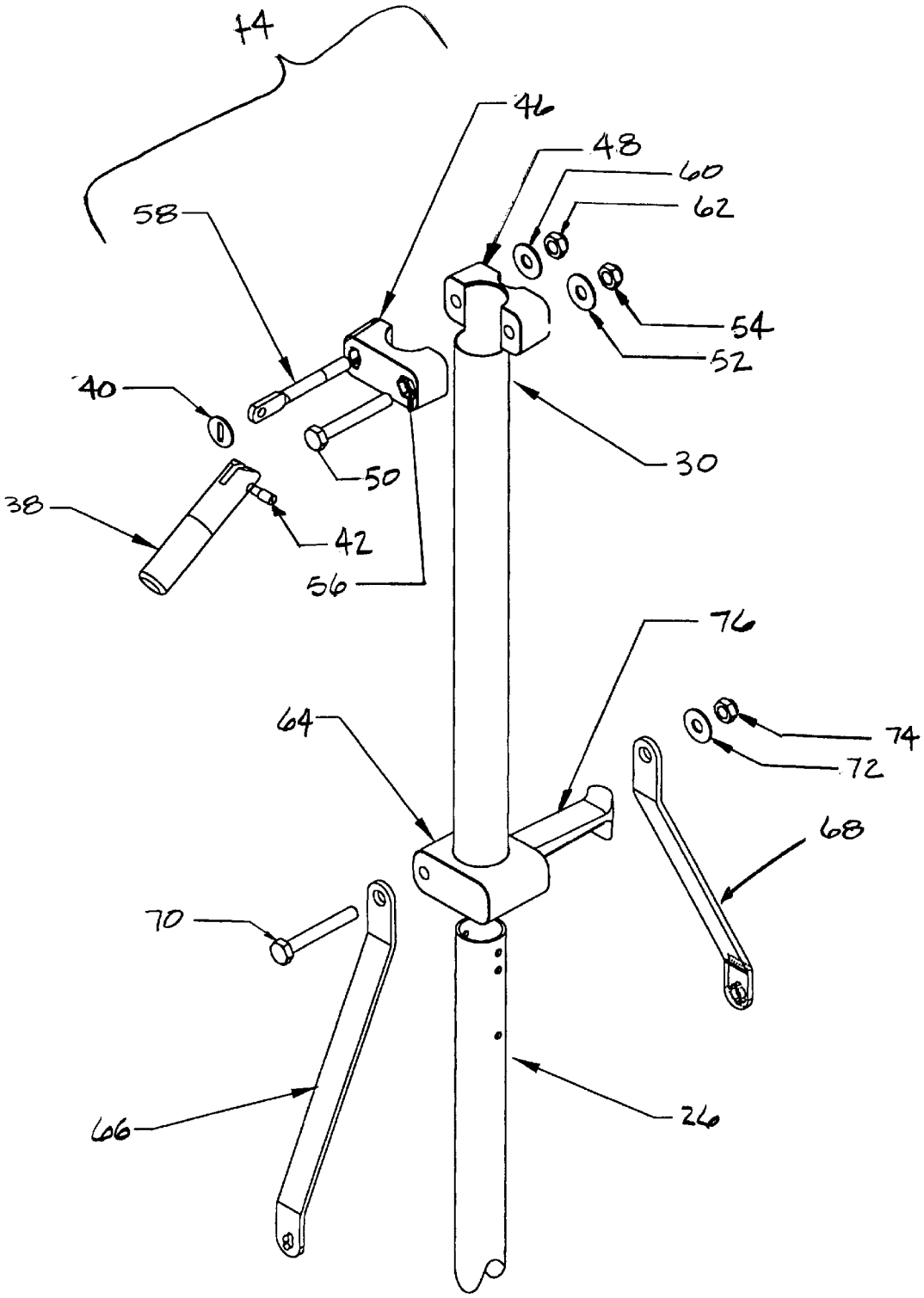
FIG. 2 is an exploded view of the handle adjustment assembly of the present invention.

The handle adjustment assembly 28 includes an adjustment member 30, a clamping mechanism 44, with an adjustment lever 38, and a lower block 64, as seen in FIG. 2. The adjustment member 30 is a sleeve sized to receive the main handle member 26 such that the handle adjustment assembly 28 is free to travel axially along the exterior of the main handle member 26 when the clamping mechanism 44 is disengaged by the adjustment lever 38. The clamping mechanism 44 and the lower block 64 are attached to the adjustment member 30 at opposite ends of the adjustment member 30. The lower block 64 is connected to the floor working unit 10 by a first link arm 66 and a second link arm 68. The link arms 66 and 68 maintain the spatial relationship between the lower block 64 and the floor working unit 10. In the preferred embodiment, a lower cord wrapping member 76 is attached to the lower block 64.

FIG. 2 illustrates the handle adjustment assembly 28 of the preferred embodiment in exploded view. The adjustment assembly 28 includes the lower block 64 attached at the lower end of the adjustment member 30 and a clamping mechanism 44 at the upper end of the adjustment member 30.

Referring to FIG. 2, the clamping mechanism 44 includes a first clamp block 46 and a second clamp block 48. The first clamp block 46 is attached to the second clamp block 48 along the two lateral edges of the first and second clamp blocks 46 and 48. Along one lateral edge, the first clamp block 46 is attached to the second clamp block 48 with a clamp block bolt 50, a clamp block washer 52, and a clamp block nut 54. The clamp block bolt 50 is inserted through the first clamp block 46 and second clamp block 48. The clamp block bolt 50 secures the first clamp block 46 to the second clamp block 48 by placing the clamp block washer 52 onto the clamp block bolt 50 after it is inserted through the first and second clamp blocks 46 and 48 and then threading and tightening the clamp block nut 54 onto the clamp block bolt 50. As shown in FIG. 2, the first clamp block 46 may include a clamp block bolt head recess 56 for receiving the head of the clamp block bolt 50. The clamp block bolt head recess 56 prevents rotation of the clamp block bolt 50, and thus enables the clamp block nut 54 to be tightened using only one wrench. Along the second lateral edge, the first clamp block 46 is attached to the second clamp block 48 with an adjustment rod 58. The adjustment rod 58 may be a rod having a threaded end and a flattened end. The flattened end has an aperture for receiving the adjustment lever securement device 42 which connects the adjustment lever 38 to the adjustment rod 58. The adjustment lever 38 is attached to the adjustment rod 58 by placing the adjustment lever washer 40 onto the adjustment rod 58. The adjustment lever washer 40 has a slot sized to receive the flattened end of the adjustment rod 58. The adjustment lever 38 has gripping end and a cam surface end. The cam surface end of the adjustment lever 38 includes a groove sized to receive the flattened end of the adjustment rod 58 and an aperture to receive the adjustment lever securement device 42. The groove for receiving the flattened end of the adjustment rod 58 is perpendicular to the aperture for receiving the adjustment lever securement device 42. The adjustment lever 38 is attached to the adjustment rod 58 by inserting the flattened end of the adjustment rod 58 into the groove in the adjustment lever 38 and inserting the adjustment lever securement device 42 through the aligned apertures in the adjustment rod 58 and the adjustment lever 38. The adjustment rod 58 is inserted through the first clamp block 46 and the second clamp block 48. The adjustment rod 58 is then secured to the first and second clamp blocks 46 and 48, in the manner described above for the clamp block bolt 50, by the adjustment rod washer 60 and the adjustment rod nut 62.

The first and second link arms 66 and 68 are attached to the handle adjustment assembly 28 at the lower block 64. Apertures for receiving a link arm bolt 70 are provided in the one end of the first and second link arms 66 and 68 and the lower block 64. The apertures of the first and second link arms 66 and 68 are aligned with the aperture in the lower block 64 on opposite sides of the lower block 64. The link arm bolt 70 is inserted through the first link arm 66, the lower block 64, and the second link arm 68. The link arm bolt is secured by a link arm washer 72 and a link arm nut 74.

Figure 3:
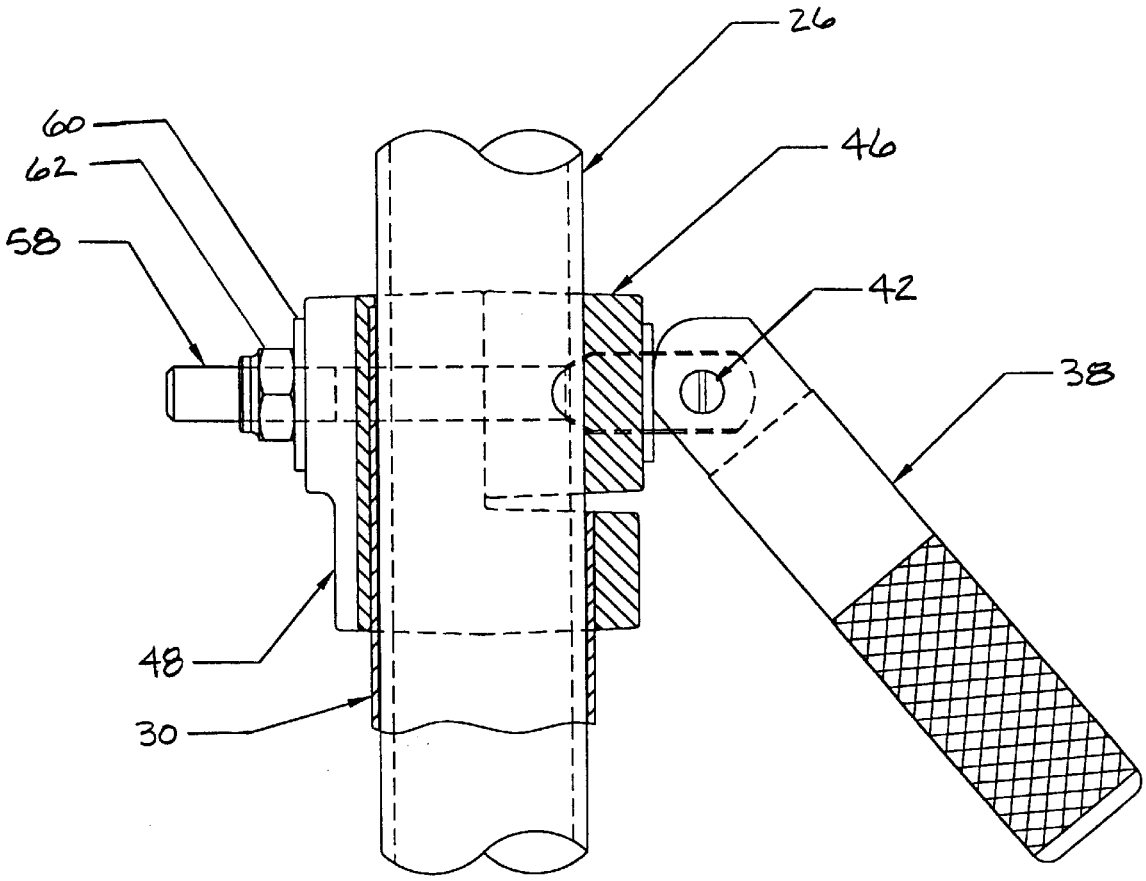
FIG. 3 is a partial cross-sectional view of the clamping mechanism of the present invention.

FIG. 3 illustrates the clamping mechanism 44 in its secured position. The main handle member 26 is received into the adjustment member 30. The adjustment lever 38 may be pivoted about the adjustment lever securement device 42. The cam surface end of the adjustment lever 38 operates to force the first clamp block 46 and second clamp block 48 together by creating tension in the adjustment rod 58 as secured by the adjustment rod washer 60 and the adjustment rod nut 62. The tension in the adjustment rod 58 is maintained by a landing on the cam surface end of the adjustment lever 38. The main handle member 26 and the adjustment member 30 are held in relative position to one another by the friction created by the above-described clamping action between the main handle member 26 and the first and second clamp blocks 46 and 48.

Figure 4B:
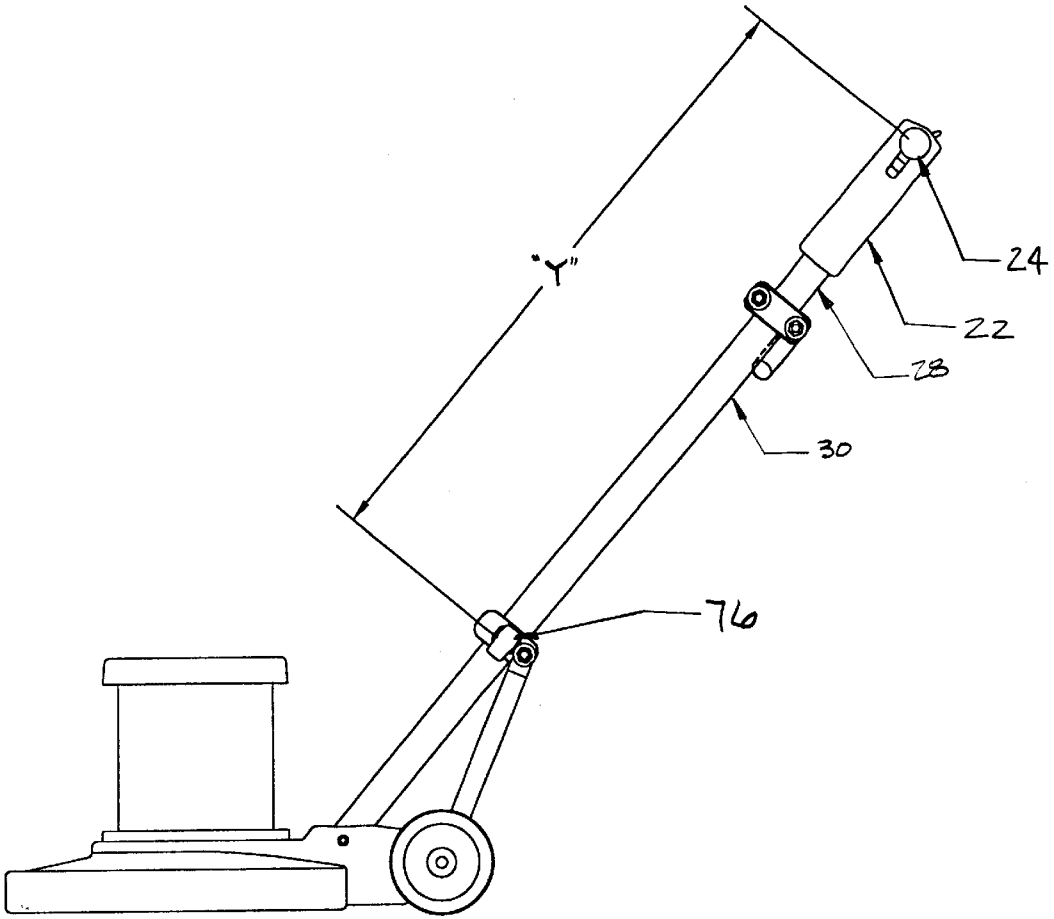
FIG. 4B is an elevation view of the floor care machine of the present invention is an operating position.
Figure 4A:
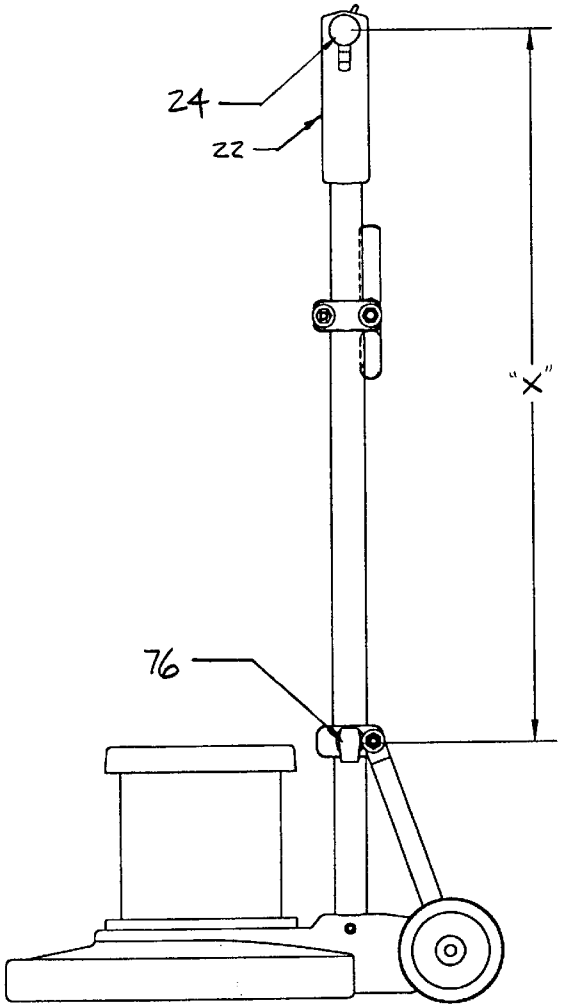
FIG. 4A is an elevation view of the floor care machine of the present invention in the stored position.

FIG. 4A and FIG. 4B illustrate an additional feature of the present invention. FIG. 4A shows the floor machine 8 in the "stored" position; the handle unit 20 is vertical in this position. Dimension "X" is the distance between the lower cord wrapping member 76 and the gripping handle 24 when the handle unit 20 is in the stored position. FIG. 4B shows the floor machine 8 with the handle unit 20 in one possible working position. Dimension "Y" is the distance between the lower cord wrapping member 76 and the gripping handle 24 when the handle unit 20 is in a working position.

Dimension "X" is always greater than dimension "Y." Thus, if the floor machine power cord (not shown) is wrapped around the lower cord wrapping member 76 and the gripping handle 24 for storage, the power cord can be easily removed and set aside when the handle unit 20 is lowered into operating position. This feature also exists when the main handle assembly 22 contains an upper cord wrapping member (not shown), provided the upper cord wrapping member is mounted on the handle assembly above the adjustment member 30. Most logically, the upper cord wrapping member would be mounted on the main handle assembly 22 such that it does not interfere with the gripping handle 24, the floor working unit engagement lever 25, or the movement of the adjustment member 30 along the main handle member 26.

What is claimed is:

1. A floor machine, comprising:

a floor working unit;

a handle unit connected to said floor working unit and including a main handle assembly that includes a gripping handle; and a handle adjustment assembly including an adjustment member having a first end and a second end and a locking subassembly having an adjustment lever and a clamping mechanism, said gripping handle being closer to said first end of said adjustment member than to said second end of said adjustment member, wherein said clamping mechanism is located closer to said first end of said adjustment member than to said second end of said adjustment member.

2. A floor machine, as claimed in claim 1, wherein:

said main handle assembly includes a main handle member and said adjustment member is movable relative to said main handle member, and in which said clamping mechanism is located exteriorly of said main handle member and exterior portions of said main handle member are engaged when fixedly holding said main handle member and said adjustment member together.

3. A floor machine, as claimed in claim 1, wherein:

said clamping mechanism includes a first clamp block and a second clamp block, with each of said first and second clamp blocks being located exteriorly of said main handle assembly and in which said adjustment lever is movable to move said first and second clamp blocks toward and away from each other.

4. A floor machine, as claimed in claim 3, wherein:

said clamping mechanism includes an adjustment rod to which said adjustment lever is connected, said adjustment rod being joined to said first and second clamp blocks, said adjustment rod being configured to allow pivotal movement of said adjustment lever.

5. A floor machine, as claimed in claim 1, wherein:

said handle adjustment assembly includes a lower block at which said second end of said adjustment member is located and in which said main handle assembly includes first and second link arms, with each of said first and second link arms being connected to said lower block.

6. A floor machine, as claimed in claim 5, wherein:

said handle adjustment assembly includes a lower cord wrapping member that is joined to said lower block.

7. A floor machine, comprising:

a floor working unit;

a handle unit connected to said floor working unit and including a min handle assembly having a main handle member; and a handle adjustment assembly including an adjustment member and a locking subassembly having an adjustment lever and a clamping mechanism, said adjustment member being associated with a fixed position and a movable position, said clamping mechanism being located exteriorly of said main handle member and exterior portions of said main handle member are engaged by said clamping mechanism at least when said adjustment member is in said fixed position.

8. A floor machine, as claimed in claim 7, wherein:

said main handle assembly includes a gripping handle and said adjustment member includes a first end and a second end, with said first end being located closer to said gripping handle then is said second end, wherein said clamping mechanism is located closer to said first end of said adjustment member then to said second end of said adjustment member.

9. A floor machine, as claimed in claim 7, wherein:

said clamping mechanism includes first and second clamp blocks that are movable towards and away from each other using said adjustment lever.

10. A floor machine, as claimed in claim 9, wherein:

said clamping mechanism includes an adjustment rod to which said adjustment lever is connected, said adjustment rod interconnecting said first and second clamp blocks.

11. A floor machine, as claimed in claim 7, wherein:

said adjustment member is located outwardly of said main handle member.

12. A floor machine, as claimed in claim 7, wherein:

said adjustment member includes first and second ends and said handle adjustment assembly further includes a lower block at which said second end of said adjustment member terminates, said main handle assembly including first and second link arms, with each of said first and second link arms being connected to said lower block.

13. A floor machine, as claimed in claim 12, wherein:

said handle adjustment assembly includes a lower power cord wrapping member about which a power cord for the floor machine can be wrapped, with said lower power cord wrapping member being joined to said lower block.

14. A floor machine, as claimed in claim 13, wherein:

said main handle assembly includes an upper power cord wrapping member that is at least a part of a gripping handle of said main handle assembly.

* * * * *